US005571242A

United States Patent [19]

Demorest

[11] Patent Number: 5,571,242

[45] Date of Patent: Nov. 5, 1996

[54] ENGINE AIRFLOW SYSTEM AND METHOD

[75] Inventor: Donald R. Demorest, Fenton, Mich.

[73] Assignee: General Motors Corporation, Detroit, Mich.

[21] Appl. No.: 579,624

[22] Filed: Dec. 26, 1995

[51] Int. Cl.[6] ..... F02M 29/00

[52] U.S. Cl. ..... 123/184.21; 181/228

[58] Field of Search ..... 123/184.21, 198 E; 138/30, 125; 181/227, 228, 233

[56] References Cited

U.S. PATENT DOCUMENTS

| | | | |
|---|---|---|---|
| 3,810,526 | 5/1974 | Kawasaki . | |
| 4,315,558 | 2/1982 | Katayama | 181/228 |
| 4,578,855 | 4/1986 | Van Der Hagen . | |
| 4,711,225 | 12/1987 | Holderle et al. | 123/184.21 |
| 4,779,586 | 10/1988 | White, Jr. | 123/198 E |
| 4,782,912 | 11/1988 | Wandless | 181/229 |
| 4,790,864 | 12/1993 | Kostun . | |
| 4,826,046 | 5/1989 | Price et al. | 138/30 |
| 4,936,413 | 6/1990 | Lee | 181/264 |
| 4,984,350 | 1/1991 | Hayashi . | |
| 5,025,889 | 6/1991 | Lockwood et al. | 181/250 |
| 5,040,495 | 8/1991 | Harada et al. . | |
| 5,096,010 | 3/1992 | Ojala et al. . | |
| 5,109,422 | 4/1992 | Furukawa . | |
| 5,158,162 | 10/1992 | Fink et al. . | |
| 5,198,625 | 3/1993 | Borla | 181/248 |
| 5,217,261 | 6/1993 | DeWitt et al. . | |
| 5,256,233 | 10/1993 | Winter et al. | 138/125 |
| 5,257,316 | 10/1993 | Takeyama et al. . | |
| 5,349,928 | 9/1994 | Takahashi et al. | 123/73 A |
| 5,388,408 | 2/1995 | Lawrence | 181/228 |
| 5,485,870 | 1/1996 | Kraik | 138/125 |

OTHER PUBLICATIONS

Report 1192–Theoretical & Experimental Investigation of Mufflers W/Comments on Engine Exhaust Muffler Design; Don D. Davis, Jr., Geo. L. Stokes, Dewey Moore, Geo. L. Stevens, Jr. Langley Aeronautical Library, Langley Field, VA.

*Primary Examiner*—Marguerite McMahon
*Attorney, Agent, or Firm*—Anthony Luke Simon

[57] ABSTRACT

In a vehicle with an engine, an engine air flow system for attenuating engine noise comprising: a first flow path of air intake through which a first gas flow is substantially into the engine; a second flow path of engine exhaust in which a second gas flow is substantially out of the engine; and at least one duct in flow contact with at least one of the first and second flow paths, wherein the duct comprises: a tubular fluid flow passage; at least one open end connecting the tubular fluid flow passage to the at least one of the first and second flow paths; a support structure preventing radial collapse of the duct during occurrences of a negative pressures, caused by the engine, within the duct; and a pliant material attached to the support structure forming a gas-tight tubular duct wall for the tubular fluid flow passage, wherein the pliant material forms, on the support structure, a series of loosely pliant panels that freely move radially outwardly and inwardly, wherein during engine operation sound generating vibrations of air into one of the first and second flow passages cause the loosely pliant panels to vibrate in a direction radial with respect to the duct, wherein a detectable level of audible sound radiated by the engine is attenuated by the duct.

3 Claims, 4 Drawing Sheets

ENGINE AIRFLOW SYSTEM AND METHOD

This invention relates to an engine airflow system and method for attenuating engine-generated audible noise.

BACKGROUND OF THE INVENTION

Many vehicle manufacturers desire to reduce passenger compartment noise in motor vehicles to increase driver and passenger comfort. One source of noise that may enter the vehicle passenger compartment is engine noise generated or carried by the exhaust of the motor vehicle. Typically, the motor vehicle includes a muffler and tailpipe system to attenuate undesirable noises from the exhaust.

Another source of noise that enters the vehicle passenger compartment is engine noise broadcast by the air intake system of the vehicle engine. Because internal combustion engines comprise reciprocating pistons in cylinders that use valves to control air intake and exhaust, the air flow into the engine is not completely smooth but is pulsed. The pulsating nature of the air flow and other factors of engine design can cause shock waves in the air passages of the intake system that travel through the passages and are broadcast out of the intake duct creating additional noise making its way into the vehicle passenger compartment, for example, through the instrumentation panel.

Many techniques have been described in published literature detailing means to address the flow of noise out of the vehicle air intake to reduce engine generated noise. Such means include Helmholtz resonators, quarter wave length (side branch) ducts and even resilient ducts that are said to have noise attenuating properties. These solutions either provide only marginal improvement, have a limited operating spectrum or take up large amounts of valuable space in the vehicle engine compartment.

SUMMARY OF THE PRESENT INVENTION

It is an object of this invention to provide an engine air flow system for attenuating engine noise in accordance with Claim 1.

Advantageously, this invention provides a new duct structure for use in internal combustion engine air flow management. Advantageously, the new duct structure according to this invention provides sound attenuating functions greatly reducing sound in the frequency ranges typically generated by an internal combustion engine.

Advantageously, this invention provides a new sound attenuation system that can be used either in the air intake or exhaust out-take of a vehicle engine to provide sound attenuation in the engine air flow system.

Advantageously, this invention provides a two part structure to a duct that results in sound attenuating capabilities. The first part of the structure comprises a support structure for maintaining a minimum effective diameter of the duct to prevent collapse thereof due to low pressure that may occur within the duct. The second part includes a pliant air tight material surrounding the support structure to form a tubular duct with a series of loosely pliant sections. The duct can form a straight, bent or shaped passage, such as a snorkel or a venturi.

Advantageously then, according to an example embodiment, this invention provides, in a vehicle with an engine, an engine air flow system comprising: a first flow path of air intake through which a first gas flow is substantially into the engine and a second flow path of engine exhaust in which a second gas flow is substantially out of the engine; at least one duct in flow contact with at least one of the first and second flow paths, wherein the duct comprises a tubular flow passage, at least one open end connecting the tubular flow passage to at least one of the first and second flow paths, a support structure preventing radial collapse of the duct during occurrence of negative pressure caused by the engine within the duct, and a pliant material attached to and surrounding the support structure forming a gas type tubular duct wall for the tubular fluid flow passage wherein the pliant material forms, on the support structure, a series of loosely pliant panels that freely move radially outward and inward, wherein during engine operation sound generating vibrations of air into one of the first and second flow passages cause the loosely pliant panels to vibrate in a direction radial with respect to the duct, wherein a detectable level of audible sound radiated by the engine is attenuated by the duct.

BRIEF DESCRIPTION OF THE DRAWINGS

The present invention will now be described, by way of example, with reference to the accompanying drawings, in which.

DETAILED DESCRIPTION OF THE INVENTION

In a demonstrative example according to this invention, a solid pipe made of metal or plastic is tested for sound transmission over the frequency range from 20 to 1000 Hz. The pipe is then cut axially in half and then taped back together with axial lengths of duct tape. The reconstructed pipe is then tested again for sound transmission over the frequency range of 20 to 1000 Hz. The pipe reconstructed using the axially aligned strips of duct tape attenuates more noise over a majority of the frequency range of 20 to 1000 Hz, which is the frequency range of most motor vehicle engine noise, than the original duct. The improved sound attenuation is thought to occur due to radial expanding/contracting vibrations of the reconstructed pipe, allowed by the pliancy of the duct tape and caused by sound generating energy traveling through the pliant walls of the pipe. Some of the sound-generating energy is absorbed by the pipe as work causing the pipe to move and some of the sound generating energy is rebroadcast into and out of the pipe as self-canceling sound waves due to the symmetrical and out of phase vibrations of the pipe. In this example, the physical motion by the pipe walls increased over the motion generated on the original pipe surfaces, however, the total sound emitted from and by the pipe decreased.

In a second example according to this invention, a duct comprising a support structure of a plurality of steel strips measuring, for example, 0.035 inches thick by 0.50 inches wide are aligned axially running the length of the duct and are spaced radially about the perimeter of the duct. The steel strips are attached to circular rubber rings periodically spaced along the length of the duct. The support structure comprising the rubber rings and steel strips is covered by an airtight pliant material to form the duct wall. Tests show that a 2.75 diameter duct of such construction absorbs more engine generated noise in the 100–500 Hz range than a typical hard plastic duct of similar size.

Figure 1:
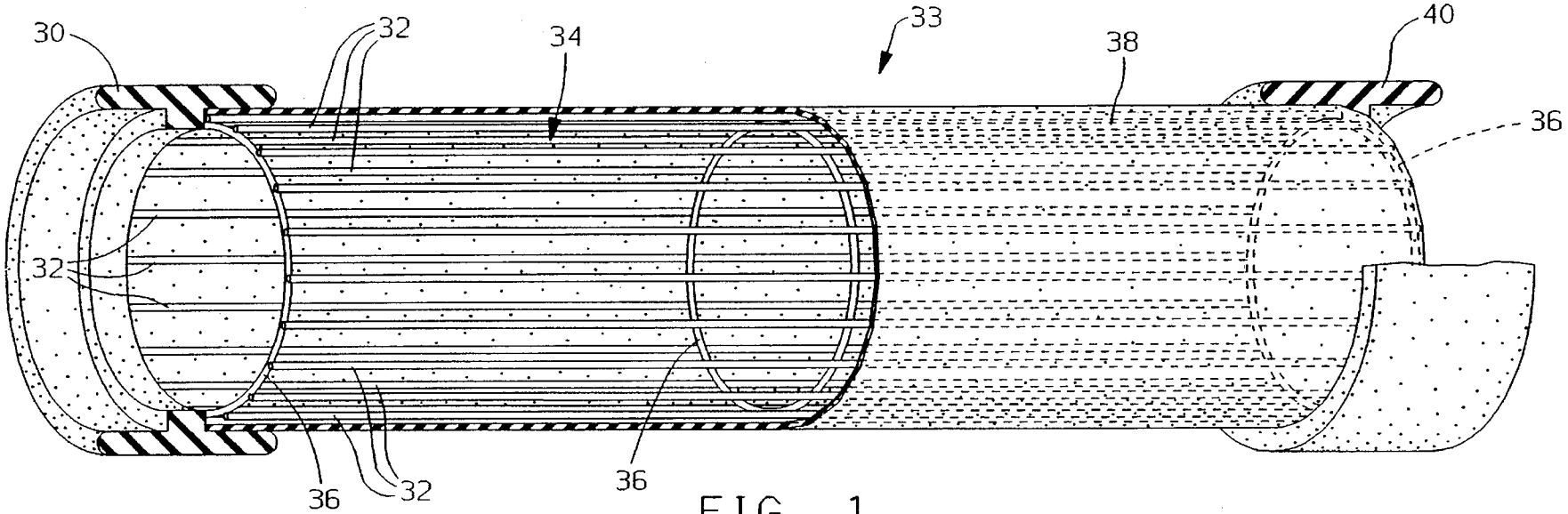
FIG. 1 illustrates an example duct structure according to this invention.

Another example according to this invention is illustrated by duct 33 in FIG. 1, having a portion of the pliant material outer duct wall 38 removed to reveal the support structure 34 thereof. The support structure 34 of the duct 33 includes a wire cage structure having axial wire members 32 and annular wire members 36 attached together in a suitable manner, i.e., through welding or soldering, to form a wire cage frame for the pliant material 38. Rubber or plastic rings may be provided as ends 30, 40 to facilitate clamping of the duct 33 to other components of the air flow system. The support structure prevents radial collapse of the duct due to events of negative pressure that may occur within the duct with respect to atmospheric pressure outside the duct during engine operation.

Surrounding and supported by the support structure in an annular manner is a pliant material 38 providing an air tight tubular wall for the duct 33. The pliant material 38 may be any of a variety of materials and is preferably characterized by high pliancy and low resiliency. Because low resiliency is preferred, materials such as rubber that store energy when deformed and return to the original shape after the force that caused the deformation is removed are not suitable pliant materials according to this invention. However, it is well understood that many pliant materials include thin layers of rubber or a rubber backing that act to seal the material for air tightness or provide resiliency only after a predetermined non-resilient deformation occurs. Such materials fall within the scope of pliant materials 38. The pliant material 38 may be held on the support structure through any suitable method including through adhesive. Thus an adhesive backed material may be used to form the wall 38. Indeed, in a simple example, duct tape may be used to form the wall 38. In another example, a suitable air tight adhesive material sold under the trade name ARNO™ may be used.

In another example, the pliant material 38 may be placed in a mold with the steel support structure 34 and attached to the support structure during the same process of molding the ends 30, 40 either using rubber, plastic or another suitable rigid or semi-rigid material. In yet another example the support structure may be made from a plastic or composite material. The result is a duct having an air flow passage as shown in FIG. 1, through which air or exhaust gases may flow and that maintains a minimum effective diameter due to the strength of the support structure. The pliant material may freely travel and vibrate at least over a range of positions due to pressure pulses and sound shock waves in the air or exhaust gas flowing through the duct 33.

Use of semi-rigid material in the support structure allows the support structure itself to flex, increasing the sound attenuating capabilities of the duct.

Figure 2:
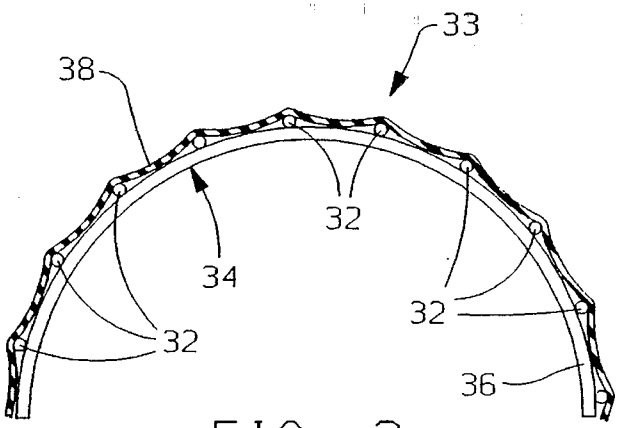
FIGS. 2 and 3 illustrate the loosely pliant sections of duct wall according to this invention.
Figure 3:
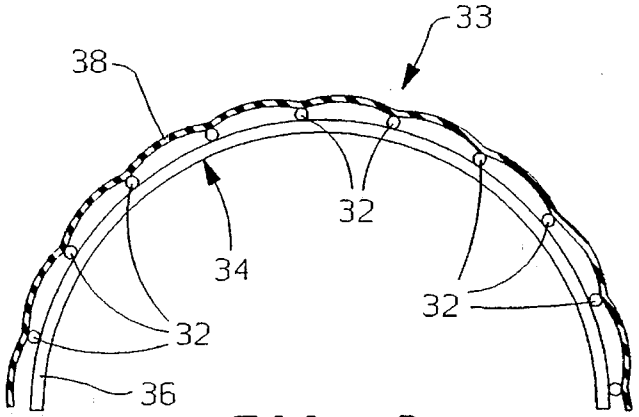

Referring now to FIGS. 2 and 3, the cross sections shown are of duct 33 in FIG. 1. The pliant material 38 is divided into rectangular (or square) sections whose boundaries are defined by the underlying support structure. FIGS. 2 and 3 show that the material in each section can freely move radially out (FIG. 2) or in (FIG. 3) in response to changing pressure and/or shock waves within the duct. The pliant material has no strict pre-formed shape to which it must return and thus is freely affected by pressure and shock waves to absorb energy that would otherwise broadcast noise and to transmit a certain percentage of that energy back into and out of the pipe as self canceling sound waves. Applying the pliant material over the support structure with too much tension reduces the sound attenuating capabilities of the duct. According to this invention, therefore, the pliant material is not tensioned so tight as to eliminate the characteristic of free pliancy.

Figure 4:
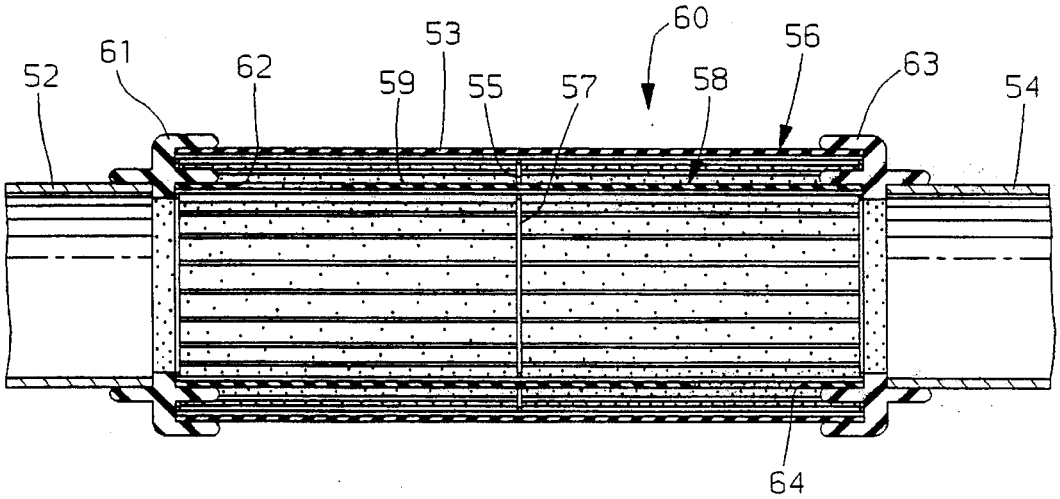
FIGS. 4, 5 and 6 illustrate example duct configurations according to this invention.

While the ducts constructed for use with this invention may be simple straight ducts, as shown above with respect to FIG. 1, the ducts may be provided in the configuration shown as reference 60 in FIG. 4. The duct 60 has an internal duct structure 58 according to FIG. 1 and an external duct structure 56 also according to FIG. 1 with a radius, for example, ⅜ inches larger than the radius of the internal duct 58, so that the two ducts are concentric and coaxial. Each of the ducts 56 and 58 has an internal support structure 55, 57 and a pliant material 53, 59 forming the tube wall. The ends 61.63 of the external duct 56 are closed to the outer periphery of duct 58.

Openings 62 and 64 at each end of the duct 58 provide ports leading from the interior of duct 58 to the annular resonance chamber between duct 58 and duct 56. In the example shown in FIG. 4, the ducts 52 and 54 on both ends of the duct 60 may be standard steel or hard plastic ducts or any other known type of duct.

Figure 5:
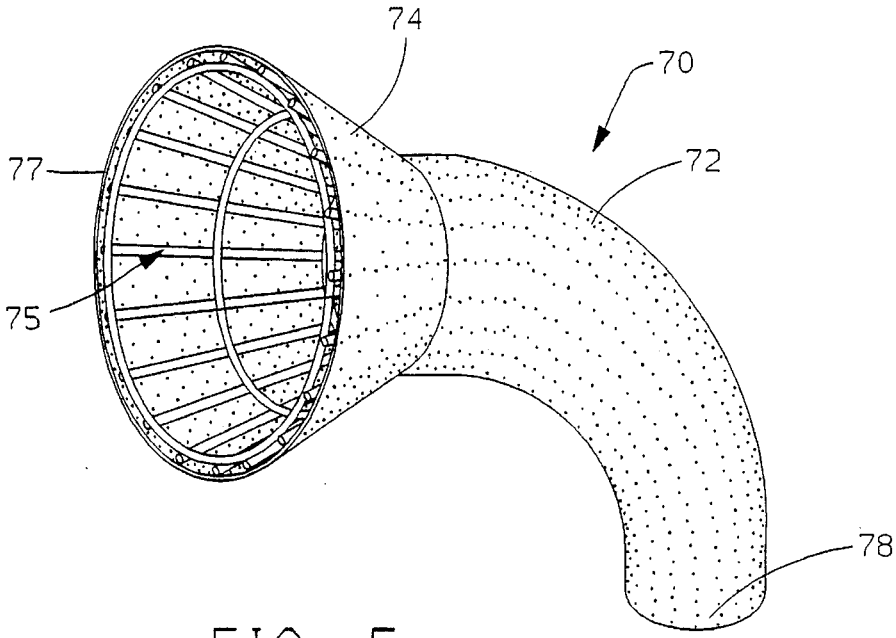

Referring to FIG. 5, the example shown illustrates that this invention is not limited to straight ducts with a single diameter or to a combination of straight ducts, but can be applied to various shaped ducts, such as duct 70, including horned or snorkeled ends 74, bent or curved portions 72 and venturi like decreasing radius portions 78. The desired shape is easily obtained by constructing the support structure 75 to the desired shape and assembling the pliant material 77 over the support structure.

Figure 6:
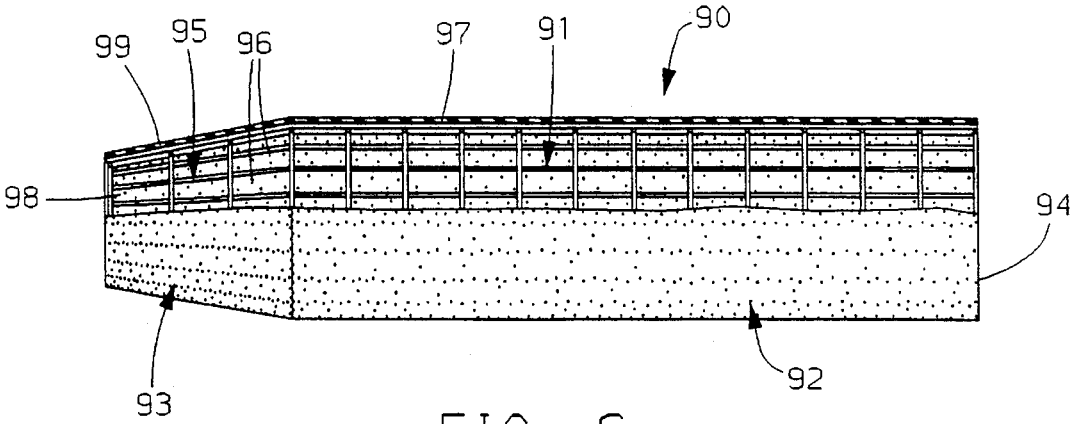

Referring now to FIG. 6, a cross section of a typical duct for use in a motor vehicle engine air flow management system is shown comprising duct structures according to this invention. The duct 90 comprises a circular cylindrical duct 92 according to FIG. 1 and venturi-shaped duct 93. The ducts 92 and 93 have support structures 91 and 95 according to this invention and pliant material walls 97 and 99. The venturi duct 93 has reflecting walls 96 for reflecting back noise waves that may be traveling out of the duct and forms a pressure transient point 98 that also reflects many sound waves back into the duct 90. Typically the duct 90 is oriented so that sound energy enters at end 94.

The duct according to this invention may be other shapes including square and rectangular, and any other shape that is symmetrical about a plane running through the center of the duct axis.

EXAMPLE 1

Figure 7:
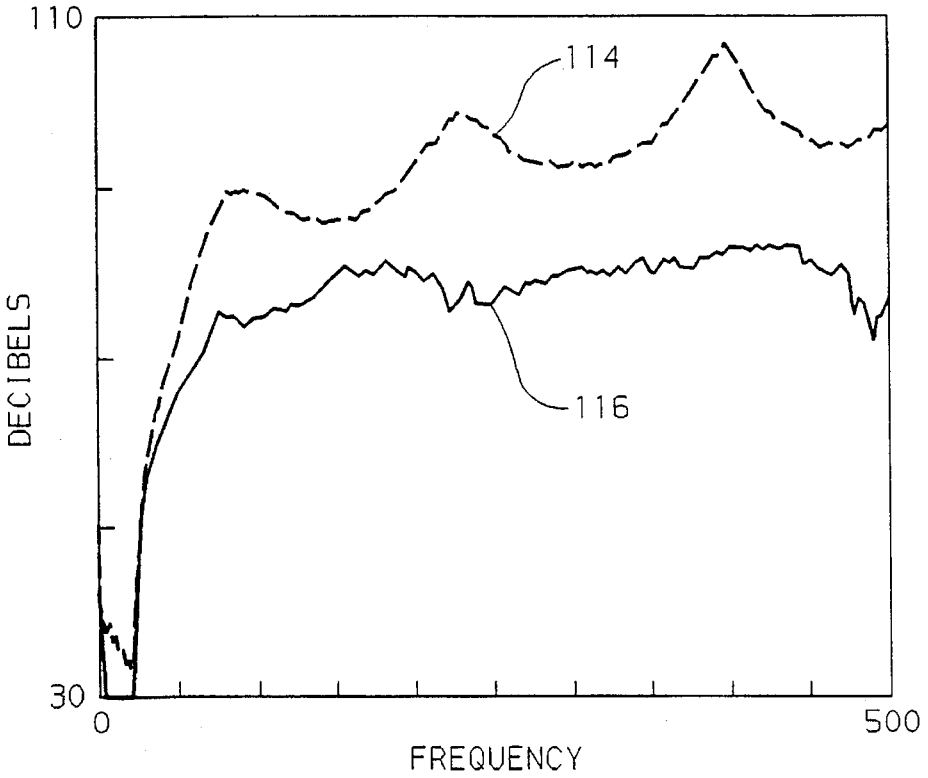
FIGS. 7–9 illustrate example sound attenuating results of various example ducts according to this invention.

Referring now to FIG. 7, a 44 inch long 2.75 inch diameter hard plastic duct having a hard plastic venturi, similar in shape to venturi duct 93 shown in FIG. 7, is compared for sound broadcast properties to a 44 inch long, 2.75 inch diameter, duct according to this invention consisting of a structure shown in FIG. 1 and an end venturi duct 93 (FIG. 6), also having a structure according to this invention. The pliant material for the duct according to this invention is an adhesive backed material sold under the trade name ARNO™. The plots show the amount of noise transmitted out of each duct from a common noise source over the frequency range of 20–500 Hz. The input noise in this and all of the examples herein is maintained at a constant decibel level over the entire frequency range tested. Trace 114 illustrates the noise transmitted through the hard plastic duct and trace 116 illustrates the noise transmitted through the duct according to this invention.

As can be seen, for the majority of the 20–500 Hz. frequency range, the duct according to this invention transmits less noise and attenuates more noise from the sound generator. A majority of the automotive engine generated duct noise is in the frequency range of 100–500 Hz. and, as shown in FIG. 7, the pliant wall duct according to this invention attenuates significantly more noise over the 100 to 500 Hz. range than the hard plastic duct.

EXAMPLE 2

Figure 8:
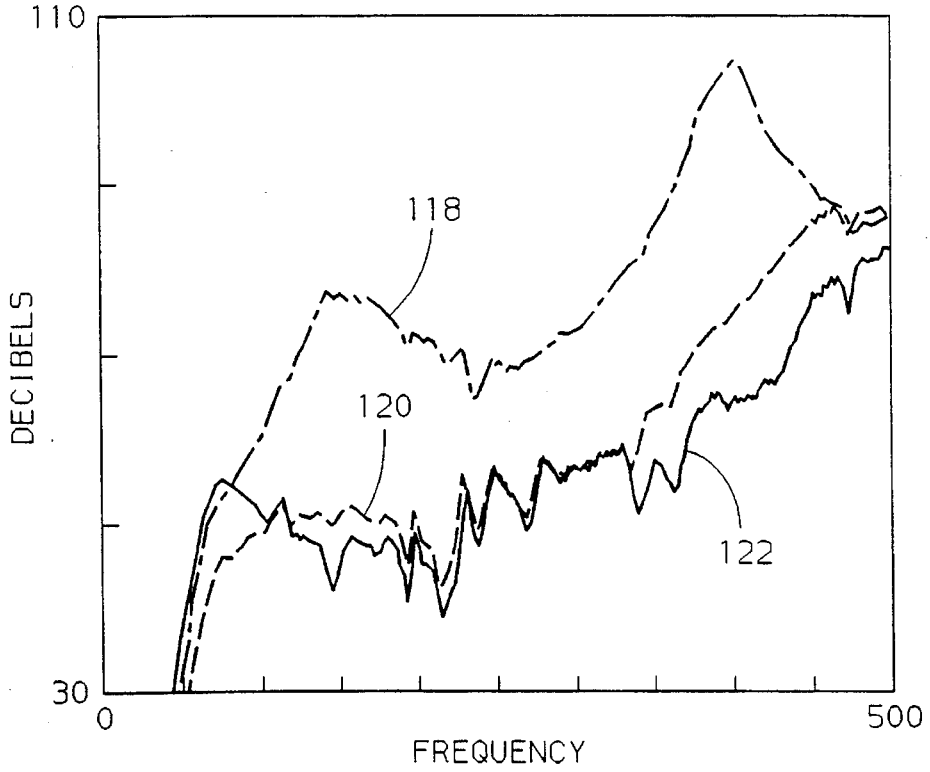

Referring now to FIG. 8, the trace 118 graphs the noise transmission of a 24 inch long, 2.75 inch diameter hard plastic duct for the frequency range of 20–500 Hz. Trace 122 graphs the noise transmission performance over the same range when 12 inches of the hard plastic duct is removed and replaced with a 12 inch section of duct constructed according to FIG. 1 described above. Trace 122 illustrates that the addition of the 12 inch section of duct according to FIG. 1 achieves significant noise attenuation for almost the entire frequency range of 20–500 Hz over the duct represented by trace 118.

The trace 120 graphs the noise transmission of a duct similar to that used to generate trace 122 with the addition of a ten inch long exterior duct around and coaxial with the twelve inch section of duct constructed according to FIG. 1. The exterior duct has a diameter ⅜ inches greater than that of the interior duct and forms an annular passage around the interior pliant wall duct providing the configuration of reference 60 shown in FIG. 4. The exterior duct is also constructed according to FIG. 1 with a pliant wall and the annular passage between the exterior and interior ducts is ported to the flow passage of the interior pliant wall duct. Trace 120 illustrates that the duct according to this invention with the configuration of reference 60 in FIG. 4 provides further improvement in the amount of low frequency attenuation. [cl] EXAMPLE 3

Figure 9:
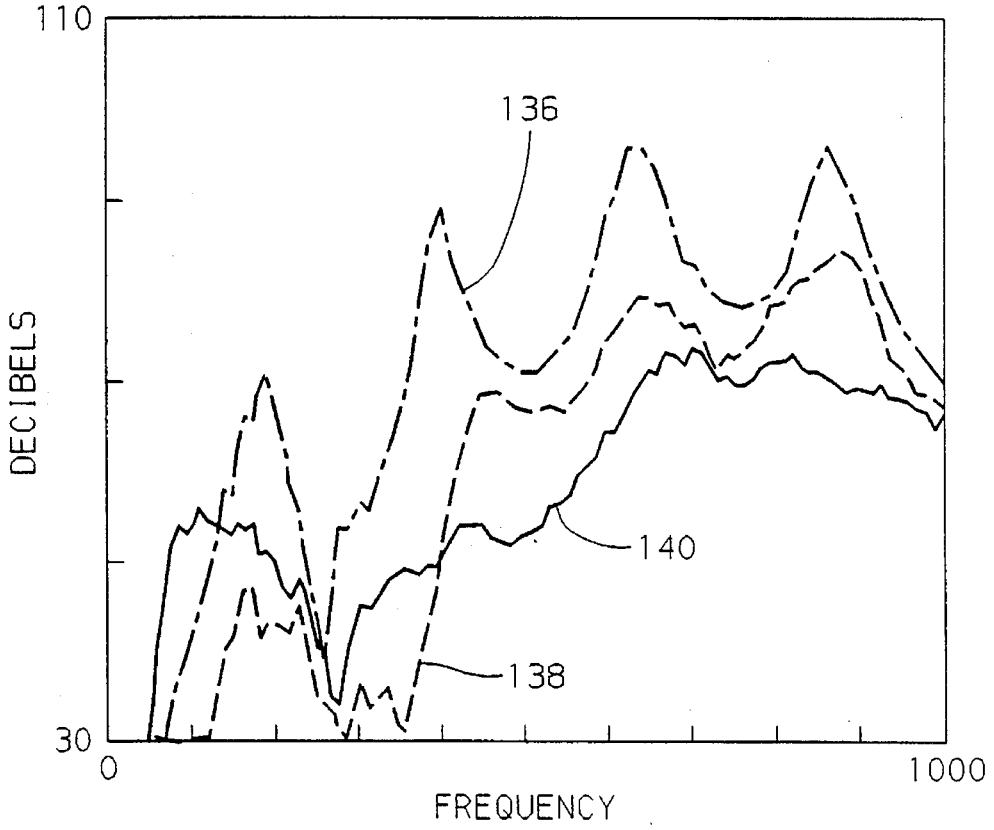

Referring now to FIG. 9, three ducts are tested over a 20–1000 Hz. frequency range for noise transmission. Trace 136 illustrates a 24 inch duct having a first section 12 inches long and a second section made of a spiral wire frame with fabric attached over the spiral wire frame. The spiral frame acts as a spring trying to unwind, causing a large amount of tension in the fabric that maintains the fabric stiff so that the fabric is no longer freely pliant. Thus plot 136 is not for a duct according to this invention. Such fabric covered wire frame ducts are known to those skilled in the art. Trace 138 illustrates the sound transmission response with 12 inches of plastic duct and 12 inches of duct constructed according to FIG. 1, covered with a rubber backed fabric available from Fabreeka™, Boston, Mass. Trace 140 illustrates a 25 inch long, 2.75 inch diameter ARNO™ covered duct according to FIG. 1. As can be seen, over a majority of the 20–1000 Hz. range, the two ducts according to this invention, represented by the traces 138 and 140, provide improved sound attenuation over the fabric covered spiral-shaped wire frame duct.

Figure 10:
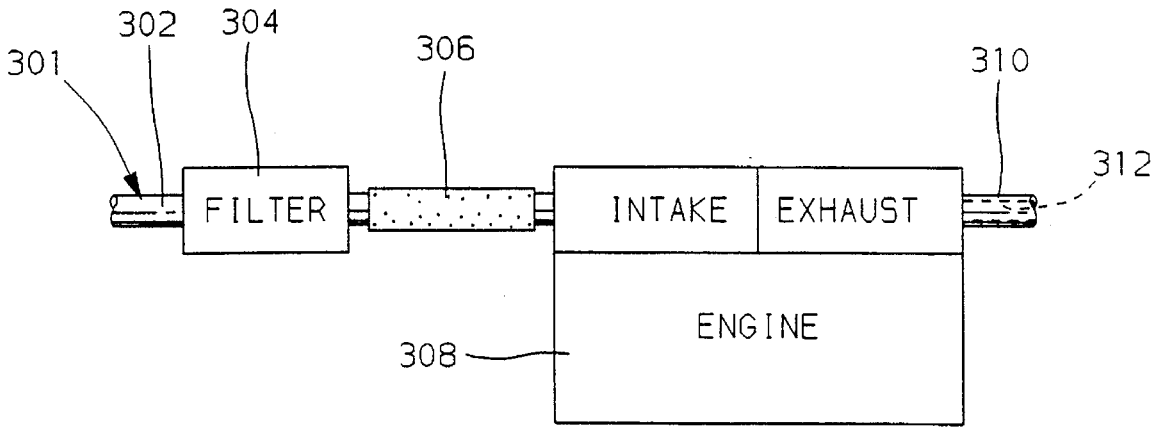
FIG. 10 illustrates an example engine air flow management system according to this invention.

Referring now to FIG. 10, an example automotive internal combustion engine air flow system is shown. The system has an air intake of a known type (not shown) that leads to the intake passage 301 comprising a duct 302 leading to air filter 304, which filters the intake air in a known manner. Duct 306 leads from the air filter 304 to the air intake of the engine 308. Any of the intake ducts represented by references 302, 306, or all thereof, are constructed according to this invention.

The engine exhaust typically leaves the engine manifold to an exhaust manifold pipe 310 which connects passage 312 to a catalytic converter. The exhaust then flows through more piping to a muffler (not shown) and a tail pipe (also not shown). Any of the exhaust connecting pipes (i.e., pipe 310) may be made according to this invention with the restriction that the support frame and pliant material be able to withstand the heat and chemistry generated by the exhaust gases.

A simple substitution of ducts according to this invention in place of prior art hard plastic or metal ducts or pipes, or in place of other ducts with sound attenuating capabilities inferior to those demonstrated by this invention, enable a quieter vehicle due to less noise being radiated by the engine air flow and exhaust gas management system. The advantages according to this invention are achieved without requiring added space such as the space typically taken up by quarter wave length tubes, volume resonators and expansion chambers.

A further advantage according to this invention as compared to many resonators is an extreme insensitivity to tolerance variations. For example, a Helmholtz resonator's frequency and noise attenuation response can vary drastically by a tolerance variation of just one or two millimeters in the length or width of the neck porting the resonator to the air flow system. This can cause the resonator to have a response completely missing its target attenuation and frequency. In contrast, ducts constructed according to this invention have been hand made with large tolerance variations in diameter, spacing of the frame, etc., while maintaining similar attenuation levels over a large spectrum of noise frequencies.

I claim:

1. In a vehicle with an engine, an engine gas flow system for attenuating engine noise, comprising:

a first flow path of air intake through which a first gas flow is substantially into the engine;

a second flow path of engine exhaust in which a second gas flow is substantially out of the engine; and at least one duct in flow contact with at least one of the first and second flow paths, wherein the duct comprises:

a tubular fluid flow passage;

at least one open end connecting the tubular fluid flow passage to the at least one of the first and second flow paths;

a support structure preventing radial collapse of the duct during occurrences of negative pressures, caused by the engine, within the duct; and a pliant material attached to the support structure forming a gas-tight tubular duct wall for the tubular fluid flow passage, wherein the pliant material forms, on the support structure, a series of loosely pliant panels that freely move radially outwardly and inwardly, wherein during engine operation sound generating vibrations of air into one of the first and second flow passages cause the loosely pliant panels to vibrate in a direction radial with respect to the duct, wherein a detectable level of audible sound radiated by the engine is attenuated by the duct.

2. An engine gas flow system for attenuating engine noise according to claim 1, wherein the loosely pliant panels are rectangular in shape.

3. An engine airflow method for reducing an audible sound of an internal combustion engine with an air intake path through which air substantially enters the engine and an exhaust path through which engine exhaust substantially exits the engine, comprising the steps of:

connecting at least one end of a duct to at least one of the air intake path and the exhaust path;

supporting the duct to prevent the radial collapse thereof; and providing on a tubular wall of the duct, a plurality of freely pliant panels able to non-resiliently move radially outwardly and inwardly; and providing a flow of gas containing sound generating vibrations through the at least one of the air intake path and the exhaust path, wherein a detectable level of audible sound radiated by the engine is reduced.

* * * * *